US011753922B1

(12) United States Patent
Buerger et al.

(10) Patent No.: US 11,753,922 B1
(45) Date of Patent: Sep. 12, 2023

(54) CONTROL SYSTEMS AND METHODS TO ENABLE AUTONOMOUS DRILLING

(71) Applicant: National Technology & Engineering Solutions of Sandia, LLC, Albuquerque, NM (US)

(72) Inventors: Stephen Buerger, Albuquerque, NM (US); Anirban Mazumdar, Atlanta, GA (US); Steven James Spencer, Albuquerque, NM (US); Timothy James Blada, Albuquerque, NM (US); Jiann-Cherng Su, Albuquerque, NM (US); Elton K. Wright, Rio Rancho, NM (US); Adam Foris, Albuquerque, NM (US); David W. Raymond, Edgewood, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 17/698,213

(22) Filed: Mar. 18, 2022

Related U.S. Application Data

(63) Continuation of application No. 17/157,614, filed on Jan. 25, 2021, now Pat. No. 11,280,173, which is a (Continued)

(51) Int. Cl.
*E21B 44/08* (2006.01)
*E21B 1/38* (2006.01)
*E21B 49/00* (2006.01)

(52) U.S. Cl.
CPC ..... *E21B 44/08* (2013.01); *E21B 1/38* (2020.05); *E21B 49/003* (2013.01); *E21B 2200/22* (2020.05)

(58) Field of Classification Search
CPC ..... E21B 44/08; E21B 44/02; E21B 44/00; E21B 1/38; E21B 1/00; E21B 49/003; E21B 49/00; E21B 2200/22; E21B 2200/00
See application file for complete search history.

(56) References Cited

U.S. PATENT DOCUMENTS 10,221,671 B1 * 3/2019 Zhang ..... E21B 44/00
2012/0085584 A1 4/2012 Jiao et al.
(Continued)

OTHER PUBLICATIONS

D.A. Glowka; Development of a Method for Predicting the Performance and Wear of PDC Drill Bits; Jun. 1987; SAND86-1745, 205 pages.

(Continued)

*Primary Examiner* — Mohamed Charioui
(74) *Attorney, Agent, or Firm* — Daniel J. Jenkins

(57) ABSTRACT

A system or method for drilling includes autonomously controlling a rotary or percussive drilling process as it transitions through multiple materials with very different dynamics. The method determines a drilling medium based on real-time measurements and comparison to prior drilling data, and identifies the material type, drilling region, and approximately optimal setpoint based on data from at least one operating condition. The controller uses these setpoints initially to execute an optimal search to maximize performance by minimizing mechanical specific energy. Near-bit depth-of-cut estimations are performed using a machine learning prediction deployed in an embedded processor to provide high-speed ROP estimates. The sensing capability is coupled with a near-bit clutching mechanism to support drilling dysfunction mitigation.

17 Claims, 7 Drawing Sheets

Related U.S. Application Data continuation-in-part of application No. 15/880,109, filed on Jan. 25, 2018, now Pat. No. 10,900,343.

(56) References Cited

U.S. PATENT DOCUMENTS

| | | | | |
|---|---|---|---|---|
| 2015/0233229 | A1* | 8/2015 | Benson | E21B 47/10 700/275 |
| 2015/0252664 | A1* | 9/2015 | Astrid | E21B 21/08 700/275 |
| 2016/0110481 | A1 | 4/2016 | Jian et al. | |
| 2017/0260822 | A1* | 9/2017 | Edbury | E21B 44/06 |
| 2017/0335670 | A1* | 11/2017 | Dykstra | E21B 44/00 |
| 2018/0038215 | A1 | 2/2018 | Badkoubeh et al. | |

OTHER PUBLICATIONS

E. Detournay, P. Defourny; A Phenomenological Model of the Drilling Action of Drag Bits; International Journal of Rock Mechanics and Mining Sciences 29 (1); 1992; 13-23.

Raymond, D.W.; PDC Bits Demonstrate Benefit Over Conventional Hard-Rock Drill Bits; Geothermal Resources Council Transactions; Sep. 2001, 10 pages.

E. Detournay, T. Richard, M. Shepherd; Drilling Response of Drag Bits: Theory and Experiment; International Journal of Rock Mechanics & Mining Sciences; 2008; 45; 1347-1360.

F. E. Dupriest; Comprehensive Drill Rate Management Process to Maximize Rate of Penetration; SPE 102210; SPE Annual Technical Conference and Exhibition; Sep. 2006; San Antonio, TX, 9 pages.

R. Teale; The Concept of Specific Energy in Rock Drilling; International Journal of Rock Mechanics and Mining Sciences and Geomechanics; 1965; 2; 57-73.

Freedonia Group; Drilling Products & Services; Study #3286; http://www.freedoniagroup.com/Drilling-Products-And-Services.html; 2015.

A. W. Eustes III; The Evolution of Automation in Drilling; 2007 SPE Annual Technical Conference; Nov. 2007; 1-5; Anaheim, California.

J. Dunlop, R. Isangulov, W. Aldred, H. A. Sanchez, R.L. Flores, J. Belaskie, et al.; Increased Rate of Penetration Through Automation; Paper IADC/SPE 139897; SPE/IADC Drilling Conference and Exhibition; Mar. 1-3, 2011; Amsterdam, The Netherlands, 11 pages.

F.E. Dupriest and W.L. Koederitz; Maximizing Drill Rates with Real-Time Surveillance of Mechanical Specific Energy; SPE/IADC Drilling Conference; 2005; Amsterdam, The Netherlands, Feb. 23-25, 10 pages.

C. D. Chapman, J. L. S. Flores, R. D. L. Perez, H. Yu; Automated Closed-loop Drilling with ROP Optimization Algorithm Significantly Reduces Drilling Time and Improves Downhole Tool Reliability; Paper IADC/SPE 151736; SPE/IADCDrilling Conference and Exhibition; Mar. 6-8, 2012; San Diego, California, 7 pages.

D. Sui, R. Nybo, V. Azizi; Real-time Optimization of Rate of Penetration during Drilling Operation; 2013 10th IEEE International Conference on Control and Automation; June 12-14, Hangzhou, China, pp. 357-362.

A. T. Bourgoyne, F.S. Young; A Multiple Regression Approach to Optimal Drilling and Abnormal Pressure Detection; Journal of the Society of Petroleum Engineers; 1974, 371-384; vol. 14(4).

G. Boyadjieff, D. Murray, A. Orr, M. Porche, P. Thompson; Design Considerations and Field Performance of an Advanced Automatic Driller; Paper SPE/IADC 79827; SPE/IADC Drilling Conference; Feb. 2003; 1-11; Amsterdam, The Netherlands.

R. Jorden, O. Shirley; Application of Drilling Performance Data to Overpressure Detection; Paper SPE 1407; SPE Symposium on Offshore Technology and Operations; Nov. 1966; pp. 1387-1394; New Orleans, Louisiana.

W.A. Hustrulid and C. Fairhurst; A Theoretical and Experimental Study of the Percussive Drilling of Rock; Int. J. Rock Meeh. Min. Sci.; 1971-2; 8:311-356 and 9:417-449; parts I-IV.

G. L. Cavanough, M. Kochanek, J.B. Cunningham and I.D. Gipps; A Self-Optimizing Control System for Hard Rock Percussive Drilling; IEEE/ASME Transactions on Mechatronics; 2008; 13(2):153-157.

F.B.E Depouhon; Integrated Dynamical Models of Down-the-Hole Percussive Drilling; PhD Dissertation; 2014; University of Minnesota, 205 pages.

M. Amjad; Control of ITH Percussive Longhole Drilling in Hard Rock; PhD Thesis; 1996; McGill University; Montreal Canada, 83 pages.

P. Beater; Pneumatic Drives; Springer-Veriag Berlin Heidelberg; 2007; 325 pages.

M. Sorli, G. Figliolini, and S. Pastorelli; Dynamic Model and Experimental Investigation of a Pneumatic Proportional Pressure Valve; IEEE/ASME Transactions on Mechatronics; 2004; 9(1):78-86.

G. Chowdhary, T. Yucelen, M. Muhlegg and E.N. Johnson; Concurrent Learning Adaptive Control of Linear Systems with Exponentially Convergent Bounds; Int. J. Adaptive Control and Signal Processing; 2013; 27:280-301.

D. Raymond, M. Mesh and S. Buerger; Dynamic Substructuring of Drillstring Computational Models for Exploration of Actuator Alternatives; Third Intl. Colloq. On Nonlinear Dynamics and Control of Deep Drilling Systems; 2014; Minneapolis, Minnesota, 14 pages.

D.W. Raymond, S.P. Buerger, A. Cashion, M. Mesh, W. Radigan and J.-C. Su; Active Suppression of Drilling System Vibrations for Deep Drilling; Sandia National Laboratories Report; 2015; SAND2015-9432, 280 pages.

S.P. Buerger, M. Mesh and D.W. Raymond; Port Function Based Modeling and Control of an Autonomously Variable Spring to Suppress Self-excited Vibrations While Drilling; American Control Conference; May 24-26, 2017; Seattle, WA; 6 pages.

N. Hogan; Impedance control: An Approach to Manipulation; ASME Journal of Dynamic Systems, Measurement and Control 107; 1985; 1-24.

N. Hogan and S. Buerger; Impedance and Interaction Control; Robotics and Automation Handbook; 2005; 19-1; CRC Press, New York.

J. Kiefer; Sequential Minimax Search for a Maximum; Proc. Amer. Math. Soc.; 1953; 4(3):502-506.

Basuray, P.K., B.K. Misra, and G.K. Lal; Transition from Ploughing to Cutting During Machining with Blunt Tools; Wear; 1997; 43; 341-349.

V. N. Vapnik and A. Y. Lerner; Pattern Recognition Using Generalized Portraits; Automation and Remote Control; 1963; 24(6):774 780.

* cited by examiner

CONTROL SYSTEMS AND METHODS TO ENABLE AUTONOMOUS DRILLING

RELATED APPLICATIONS

This application is a Continuation of U.S. patent application Ser. No. 17/157,614, filed on Jan. 25, 2021, entitled "CONTROL SYSTEMS AND METHODS TO ENABLE AUTONOMOUS DRILLING," which is a Continuation-in-Part of U.S. patent application Ser. No. 15/880,109, filed on Jan. 25, 2018, entitled "CONTROL SYSTEMS AND METHODS TO ENABLE AUTONOMOUS DRILLING," the entireties of both are incorporated herein by reference.

STATEMENT REGARDING FEDERALLY SPONSORED RESEARCH OR DEVELOPMENT

This invention was developed under Contract No. DE-NA0003525 awarded by the United States Department of Energy/National Nuclear Security Administration. The Government has certain rights in this invention.

BACKGROUND OF THE INVENTION

The application generally relates to control systems and methods for drilling. The application relates more specifically to autonomous methods for controlling drilling parameters based on drilling medium characteristics. The application further relates to systems and methods to affect efficient drilling in unknown media while preventing equipment damage without requiring human operator actions.

Historically the process of drilling, e.g. for oil and gas exploration, geothermal wells, and the like, has been a process requiring users to apply intuition and experience to continuously adjust drilling system parameters to achieve acceptable drilling. Parameters must change as the drilling system dynamics, the drilling medium, e.g. rock types, and other process elements vary. When drilling dysfunction arises, operators must intervene to protect equipment and the integrity of the wellbore. Automation and autonomous control of drilling equipment may significantly improve performance by allowing more rapid adjustment to varying conditions based on measurement of drilling parameters and on models of drilling, wherein the models are based on scientific principles. The use of such technology may increase drilling speed, reduce equipment failure, and provide greater energy efficiency in the drilling process. Given the large scale and enormous costs associated with drilling, changes of a few percent in such metrics may reap enormous economic benefits.

Rotary drilling is a complex process that is largely controlled by highly trained and experienced human operators. Drilling conditions may change constantly during the drilling operation in response to heterogeneous rock formations, bit wear, and interactions between a drill string and the wellbore. Furthermore, observed conditions at the surface may differ dramatically from conditions downhole. Improving drilling performance can have an enormous economic impact by reducing the time spent drilling, on a per-unit basis, and by reducing costly equipment failures.

Drilling operations are repetitive and inherently dangerous. Automation of drilling operations and autonomous control of operations may improve safety, enhance drilling operations in harsh environments, and increase drilling efficiency. Field data discloses that automated drilling systems may achieve improvements in penetration rate of 10% or greater. Despite the potential benefits from automation, field drilling is largely a manual process, currently, in which operators continuously adjust to conditions to achieve basic regulation of routine control setpoints.

Different rock types have very different characteristics defined by unique model parameters, and indiscriminate modeling across rock types will result in inaccurate predictions. Furthermore, key parameters in the most effective rock-bit interaction models also depend on bit characteristics, including wear over time. Therefore, the ability to determine the rock type and detect changes in real time is essential to successful automation.

One approach to autonomous drilling has been to use high level drilling performance metrics such as the rate of penetration (ROP) or the mechanical specific energy (MSE). MSE is the amount of energy expended in removing a unit volume of rock, with units typically in pounds per square inch (psi). For example, the Fastdrill technology by ExxonMobil estimates MSE online and provides prompts to the driller with suggested setting changes. Recently, several research groups have developed and tested optimizing automation tools that attempt to maximize ROP based on measured signals in the rock. They exploit a model to predict drilling performance. Some may employ the Bourgoyne and Young model as described in A. T. Bourgoyne, F. S. Young, "A Multiple Regression Approaches to Optimal Drilling and Abnormal Pressure Detection," Journal Of The Society Of Petroleum Engineers, Vol. 14(4), 1974, Pp. 371-384, and others employ the Jorden and Shirley model as described in R. Jorden, O. Shirley, "Application of Drilling Performance Data to Overpressure Detection," Paper SPE 1407 presented at the SPE Symposium on Offshore Technology and Operations, New Orleans, La., May 1966, pp. 1387-1394. Still others employ a phenomenological rock-bit interaction model developed by Detournay. The use of model fitting approaches may be complicated by the unknown properties of the rock formation and its inhomogeneity.

Control algorithms for drilling rely heavily or exclusively on rate of penetration (ROP) estimates (i.e. mechanical specific energy is based on ROP). While this approach works well in capturing overall system performance, it is a poor and slow indicator of acute drilling dysfunction, which is when potentially destructive events occur (whirl, stick-slip, interfacial severity, bit bounce).

ROP is typically measured using position or displacement sensors at the surface. This type of measurement is notoriously noisy, slow to update, and is delayed relative to downhole behavior. This is because these measurements are effectively filtered through the complex and slow dynamics of long, slender drillstrings, which generally feature extremely low stiffness and unpredictable friction properties. Similarly, even when dysfunctions are detected, achieving a safe response using top-hole actuation can be very slow to reduce the destructive behaviors. Therefore, as hole depth and drillstring length increase, control systems that rely exclusively on sensing, processing, control and actuation at the surface are increasingly ineffective.

Damaged components represent a major cost element of drilling operations. Costs incurred from damage include not only the direct component and installation/maintenance costs, but perhaps even more significantly the lost drilling time due to "tripping" downhole hardware out of the hole for repair or replacement, and back into the hole for continued drilling. Thus, it is desirable to avoid not only damage, but also to avoid the need to trip the system out of the hole when problematic conditions arise.

An important constraint on many drilling systems is that communications between the surface and the downhole environment are often extremely limited. For example, mud pulse communications systems communicate on the order of bits per second. While emerging "smart pipe" systems embed higher-bandwidth communications in specialized drilling pipe, this is extremely expensive and uncommon. Therefore, it is important for an intelligent system, requiring downhole elements, to have an architecture that is consistent with slow and low data-rate communications between the top hole and downhole systems.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY OF THE INVENTION

One embodiment relates to a method for autonomously controlling a rotary drilling system includes applying a predetermined force (sometimes called "weight-on-bit") setpoint to a first controller; applying a predetermined rotary speed to a second controller; applying a first controller output and a second controller output to a drilling process module; measuring a plurality of outcome parameters of the drilling process module; receiving drilling process inputs and process outcome parameters; estimating a plurality of rock parameters associated with a rock type based on drilling process inputs and process outcome parameters; comparing the estimated drilling medium (e.g. rock) parameters with a database of drilling medium profiles; determining whether a change in the outcome parameters have occurred which indicate that a change in the drilled material has occurred; searching the database rock profiles for optimal operating conditions in response to determining that a change in the material being drilled is indicated; generating an updated set of drilling parameters corresponding to the optimal operating conditions rock parameters in response to the comparing of database rock profiles; transmitting the updated set of drilling parameters comprising the force setpoint and rotary speed adjusting the drilling parameters by subtracting measured drilling parameters from the updated set of drilling parameters; generating desired control actuator setpoints for predetermined force and predetermined rotary speed; systematically varying one or more control setpoints in the vicinity of the drilling parameters indicated by the database and simultaneously evaluating process outcome parameters to identify and ultimately converge to locally optimal drilling conditions in accordance with an optimal search algorithm; and adding new relationships between drilling process inputs and process outcome parameters, obtained from measurements of the drilling process, to the database of drilling medium profiles via a machine learning process. The method integrates sensor data from top-hole and/or downhole sensors by sensor fusion and optimization algorithms to autonomously determine setpoints for the controllable parameters. The method further includes downhole processing of the measurements that are taken with downhole sensors and identifying dysfunction that risks equipment or wellbore integrity, deploying a downhole fast-acting actuator to take immediate action to protect the equipment and the wellbore in the presence of dysfunction. The method further may use low-bandwidth communications from the downhole system to the top-hole sensor fusion and optimization system to communicate data and information about the rock-bit interactions and the status of the downhole actuation system.

Another embodiment relates to a method for controlling an autonomous percussive drilling system includes applying a force applied to the rock by the weight-on-bit setting, a hammer pressure, and a rotary speed; transmitting the force, hammer pressure and rotary speed to a drilling process for a drilling rig; transmitting parameter outputs as the drilling rig penetrates into rock layers in response to the input parameter setpoints; determining a plurality of outcomes of the drilling process; and classifying the drilling medium in response to measured drilling data by applying physics-based drilling models or by comparing to an existing database of drilling medium (e.g. rock) profiles; executing an algorithm in response to determining the drilling medium to computer predetermined operating conditions associated with the drilling medium; adjusting at least one of the force, pressure, or rotary speed of the drilling system to achieve the predetermined operating conditions; systematically varying one or more control setpoints in the vicinity of the predetermined operating parameters and simultaneously evaluating process outcome parameters to identify and ultimately converge to locally optimal drilling conditions in accordance with an optimal search algorithm; and updating the physical models of drilling and/or the database of drilling medium profiles based on the input parameters and measured drilling process outcome parameters, via a machine learning process. The method further includes downhole processing of the measurements that are taken with downhole sensors and identifying dysfunction that risks equipment or wellbore integrity, deploying a downhole fast-acting actuator to take immediate action to protect the equipment and the wellbore in the presence of dysfunction. The method further may use low-bandwidth communications from the downhole system to the top-hole sensor fusion and optimization system to communicate data and information about the rock-bit interactions and the status of the downhole actuation system.

Another embodiment is directed to a drilling system that includes material detection and control systems. In particular, the new innovations focus on rapid control system response to drilling dysfunction, to enable the protection of drilling systems and components, in some cases without needing to wait for action from the surface. This embodiment includes applying a controlled drilling force, rotary speed, and fluid pressure from a top-hole system, using data available at high bandwidth from top-hole sensors and intermittent, low-bandwidth data from down-hole systems with event-driven sensor fusion and optimization algorithms to autonomously determine setpoints for the controllable parameters, deploying downhole sensing and processing to obtain and interpret immediate information on the details of the rock-drillbit interactions, processing these measurements downhole and identifying dysfunction that risks equipment or wellbore integrity, deploying a downhole actuator to take immediate action to protect the equipment and the wellbore in the presence of dysfunction, using low-bandwidth communications from the downhole system to the top-hole fusion and optimization system to communicate data and information about the rock-bit interactions and the status of the downhole actuation system.

According to an embodiment, a downhole actuation system for protecting the drilling system and wellbore from acute drilling dysfunction includes an active clutch that can disengage to prevent the transmission of drilling torques from the drillstring to the bit leading to excessive drillstring twist and stored energy, and re-engage to allow transmission of these torques is disclosed.

According to yet another embodiment, the downhole sensing and processing systems includes sensing or estimation of drilling process parameters such as force, torque, depth of cut, and rotary speed, and possibly related parameters such as temperature, pressure, vibration, and sound, and processing based on machine learning of past drilling data to estimate the true state and health of the drilling process.

An advantage of the disclosure is applications for both rotary and percussive drilling. The method includes online classification of drilling medium, e.g. rock type. For rotary drilling, the classification method includes a drilling model based on a widely accepted theoretical model of rotary drag bit drilling, and identifies material type and drilling region (e.g. I, II, or III). Drilling region (sometimes called drilling phase) refers to the range of drilling conditions in which there is a prescribed relationship, often approximated as linear, between rate of penetration (ROP) and weight-on-bit (WOB) in regions I and II; region III may exhibit a similar relationship, but more generally incorporates complex effects of system dysfunction and is not usually characterized relationally. The model includes at least three drilling regions based on the alignment of measured parameters with the model. Parameters may be compared to test parameters determined from prior drilling data. In rotary and percussive drilling, a machine learning approach may be used, and measured drilling data may be compared in real time to data from historical drilling data, and classification determinations made based on said data. Measured data is also used to augment and improve the historical drilling database via machine learning.

Another advantage is intelligent control of autonomous penetration including novel control methods and algorithms to enable autonomous drilling through multi-layered structures. Related techniques are disclosed for both rotary and percussive techniques. The disclosed methods apply knowledge of the fundamental characteristics of the drilling processes based on prior published theory and experimental data. The methods apply multilayered control systems design to achieve improved drilling performance.

Another advantage is the proposed drilling system control architecture has the potential to effectively identify and mitigate drilling dysfunctions an order of magnitude faster than current drilling systems. The combination of downhole sensing, active mitigation by downhole actuation, and data processing is a novel and unique approach to addressing non-drilling time (NDT) caused by sub-optimal drilling conditions.

This disclosure differs from existing techniques through its use of downhole sensing and intelligent downhole/top-hole event-driven information fusion. Downhole sensing enables faster and more accurate assessments of bit-rock interactions, thus providing a more accurate representation of the quality of the drilling process. Top hole sensors and actuators provide additional information and control capacity (via WOB and RPM control). This disclosure seeks to also exploit these existing top hole capabilities.

Alternative exemplary embodiments relate to other features and combinations of features as may be generally recited in the claims.

BRIEF DESCRIPTION OF THE DRAWINGS

The application will become more fully understood from the following detailed description, taken in conjunction with the accompanying figures, wherein like reference numerals refer to like elements, in which.

DETAILED DESCRIPTION OF THE INVENTION

Figure 1:
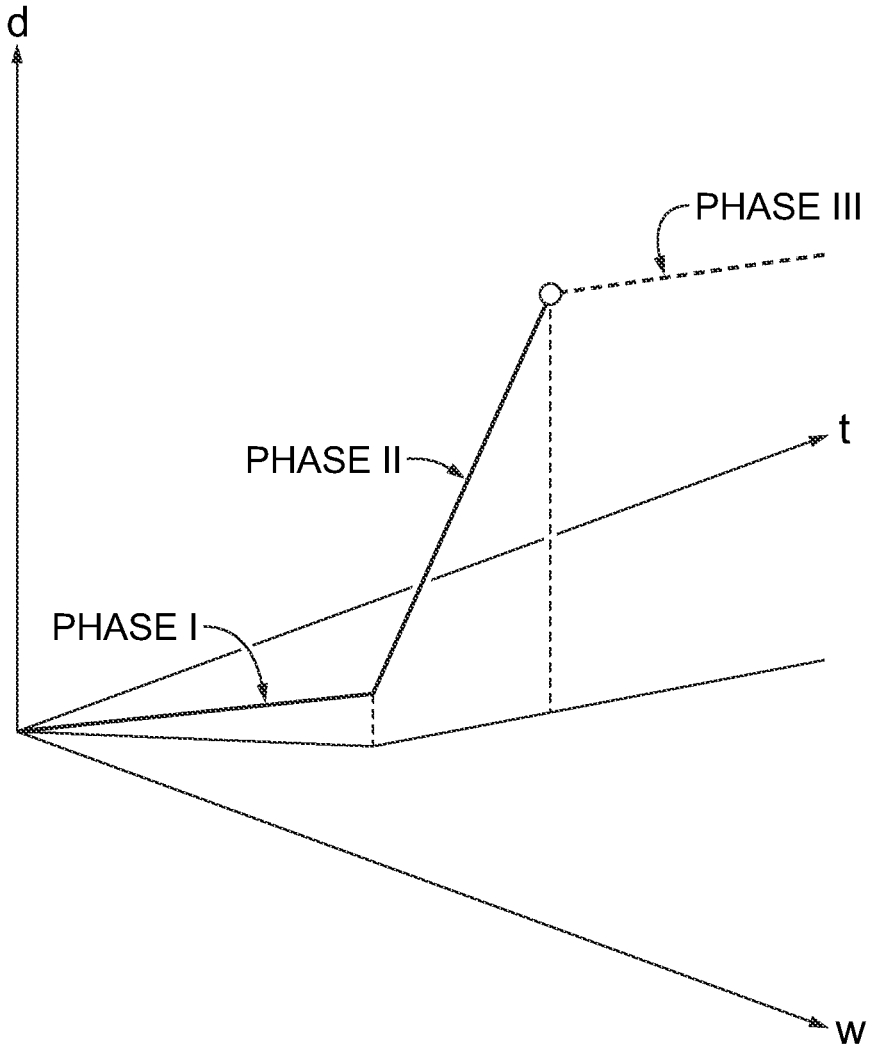
FIG. 1 shows an exemplary diagram of three phase Detournay drilling model.

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

The present disclosure is directed to systems and methods for drilling control that use material detection and control systems sensed parameters in the drilling environment to effect drilling controls. In particular, these new innovations focus on rapid control system response to drilling dysfunction to enable the protection of drilling systems and components, and in some cases without needing to wait for action from the surface. The systems and methods apply a controlled drilling force, rotary speed, and fluid pressure from a top-hole system, using data available at high bandwidth from top-hole sensors and intermittent, low-bandwidth data from down-hole systems with event-driven sensor fusion and optimization algorithms to autonomously determine setpoints for the controllable parameters, deploying downhole sensing and processing to obtain and interpret immediate information on the details of the rock-drillbit interactions, processing these measurements downhole and identifying dysfunction that risks equipment or wellbore integrity, deploying a downhole actuator to take immediate action to protect the equipment and the wellbore in the presence of dysfunction, using low-bandwidth communications from the downhole system to the top-hole sensor fusion and optimization system to communicate data and information about the rock-bit interactions and the status of the downhole actuation system.

The present disclosure is further directed to methods for fully autonomous drilling is disclosed. The methods include autonomous management of transitions between multiple layers of different material, e.g., rock layers, using previously gathered experimental data to inform the controller of the preferred operating setpoints for each material. In an embodiment, the method utilizes a Detournay model as described below for rotary drag bit drilling. Further, the method uses a classifier algorithm and database from previous drilling data to correlate measured rock properties taken during a drill operation, with rock types and desired drilling control parameters. Data from one operating point is sufficient to estimate the rock type, the drilling region, and the optimal drilling settings for that rock type. The rock type is estimated continuously. Drilling parameters are updated in response to detected variations in the rock type. Local searches are performed around the prescribed optimal settings to determine the true optimal parameter, in response to minor deviations from the database data. Low level PI controllers may be used to regulate drilling parameters to desired settings. Furthermore, the method includes using downhole sensor data obtained during the drilling process to identify impending or ongoing drilling dysfunctions such as stick slip and provide a means of mitigating the negative impact of such dysfunctions.

The Detournay model describes a phenomenological model of the drilling process for drag bits with polycrystalline diamond compacts (PDC) as the cutting surface. The Detournay model describes drilling as a three dimensional relationship between scaled weight (w), scaled torque (t), and depth of cut (d), referred to hereinafter as Detournay parameters. The scaled weight and torque values are normalized with respect to the bit diameter. Detournay parameters are employed to provide physical meaning that is not dominated by the impact of bit size and rotational speed.

The Detournay model for rotary drag bit drilling describes three drilling regimes referred to as phases I, II, and III. Phase I is characterized by frictional contact between formation and the bit, whereby w is insufficient for the cutters to penetrate the rock and the bit simply grinds at the rock. This phenomenon is a result of the cutting edge of the cutter having a finite sharpness characterized by the size of a flattened portion of the cutting edge known as a "wear flat." It is also known as plowing in metal-cutting parlance. An ideally sharp bit would have no Phase I. Phase II begins once a critical weight on bit has been reached such that the rock cannot support additional bearing stress generated on the fully engaged wear flat. Any further increase in w drives the cutter into the rock and directly translates into an increase in cutting force, causing the bit to increasingly act as if perfectly sharp. Phase II is associated with productive and efficient drilling, and thus represents the target operating region. Phase III begins after a point commonly referred to as the founder point. Drilling efficiency decreases as w increases in phase III because of system dysfunction, e.g. inability to clear cuttings or drill string resonance. Drilling performance at higher weight may be degraded through any number of mechanisms including, e.g., stick-slip and bit balling.

Percussive drilling also occurs in three drilling phases for different weight-on-bit levels. Phase I represents a regime where WOB is insufficient to maintain good contact between the hammer and rock. ROP increases linearly until WOB reaches a critical value, Fmin, where good contact is achieved. At WOB values higher than Fmin, the ROP is relatively insensitive to changes in WOB. This is region 2. Finally, region 3 can exist when WOB is so high that the motor rotation is degraded. In this case, the ROP begins to decrease with increasing WOB. At some point, excessive WOB will stall the motor and ROP will go to zero. The ROP is relatively invariant with increasing WOB in region 2. Since torque increases with WOB, more energy is consumed with greater WOB. Therefore, in general, percussive drilling may be viewed as optimal very near the region 1—region 2 transition, i.e. where WOB=Fmin. In this area, ROP is approximately maximized while energy (MSE) is lower than for higher values of WOB.

The drilling response in Detournay's model for rotary drag bit drilling describes Phases I and II as having linear relationships between w, $\tau$ and d in three-dimensional space. Furthermore, Phase I is constrained to intersect the origin. For simplicity, in one embodiment of the invention, Phase III is characterized by a linear relationship but need not be. Thus, the disclosed model for rate independent rock-bit interaction is a piecewise continuous function in three-dimensional space with three linear segments as shown in FIG. 1.

Because weight-on-bit is a controlled parameter, w may be defined as the independent variable. The drilling model requires two critical values to separate the three regions. w12 and w23 may be defined to denote the scaled weight at the phase III transition and phase II-III transition respectively. Equation 1 below may be used to compute the scaled torque t from the weight-on-bit w, to ensure continuity and intersection of the origin:

$$t = \begin{cases} a_1 w & w < w_{12} \\ a_2(w - w_{12}) + t_{12} & w_{12} < w < w_{23} \\ a_3(w - w_{23}) + t_{23} & w > w_{23} \end{cases} \quad \text{EQ. 1}$$

where: $t_{12} = a_1 w_{12}$ and: $t_{23} = a_2(w_{23} - w_{12}) + f_{12}$

Depth of cut, d, is defined similarly but with different scalar parameters a.

In an embodiment a primary metric for drilling optimization is mechanical specific energy (MSE). According to the Detournay model for rotary drag bit drilling a minimum MSE occurs at the transition from phase II to III (the founder point). This transition begins when further increases in w no longer translate into pure cutting of virgin rock, and drilling proceeds in a less efficient manner (due, for example, to regrinding of cuttings, poor energy transfer, etc.). Equation 2 below determines MSE utilizing the Detournay parameters:

$$MSE = \frac{w}{\pi R} + \frac{t}{d} \quad \text{EQ. 2}$$

where R is the bit radius. For a non-coring bit having a full cross-section, Eq. 2 computes the sum of linear and rotational energy per volume of rock removed.

Minimization of MSE is a reliable parameter for achieving high rates of penetration and avoiding potentially deleterious effects introduced during inefficient drilling. This allows the system to enter Phase III while still increasing ROP. MSE is also a useful parameter to minimize for high-performance percussive drilling. In percussive drilling, unlike in rotary drilling, the maximum ROP does not necessarily coincide with minimum MSE. It may be desirable to maximize ROP.

Figure 2:
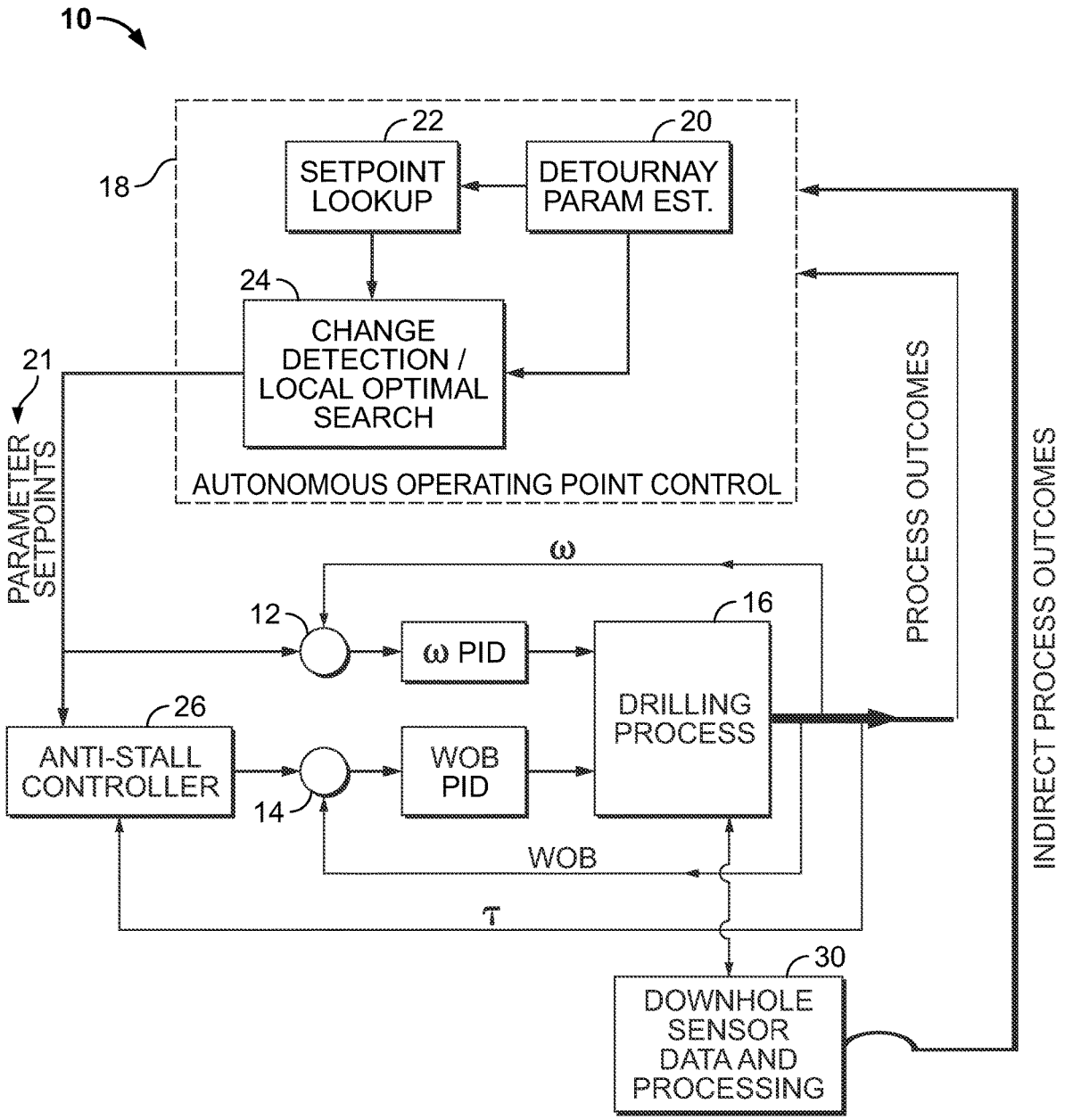
FIG. 2 shows an exemplary schematic diagram for an autonomous drilling system.

FIG. 2 is a schematic diagram for an autonomous drilling control feedback loop control method 10 for rotary drilling according to an embodiment of the disclosure. The method includes and begins with an autonomous operating point control (AOPC) process, to generate the preferred setpoints 21. The AOPC 18 includes control processing that sets initial parameter setpoints 21 that result in Phase II operation conditions FIG. 1. The control system 10 monitors signals for event-driven asynchronous data such as stick-slip drilling dysfunction from 70 to optimize to 21. The APOC 18 includes a Detournay Parameter Estimator 21 that determines the formation material and operating Phase region by comparing incoming data to reference data plotted in FIG. 1. The APOC further includes a Setpoint Lookup function 22 that determines the preferred operating setpoint based on the results from 21. The APOC 18 further includes a Change Detection/Local Optimal Search function 24 that continually monitors the process outcomes and optimizes parameter set points 21 by adjusting parameter setpoints to shift the location on the drilling model curve FIG. 1 into the transition region between Phase II and Phase III. During the drilling process 16, the APOC 18 receives process outcomes, both direct and indirect, that indicate the actual response of the physical system to the parameter setpoint inputs. The output of the AOPC 18 are parameter setpoints 21 that are used to control the high-level behavior of the drilling system.

The parameter setpoints 21 for angular velocity co are provided to the angular velocity ω controller 12, represented by the node 12 and angular velocity ω PID controller, that determines the angular velocity co setpoint provided to the drilling process 16. In other embodiments, the process controllers may include, but are not limited to angular velocity, WOB, and fluid pressure. The parameter setpoints 21 for weight-on-bit (WOB) (the surface force setpoint applied to the rock by the bit) are first provided to an anti-stall controller 26 that also receives torque and angular velocity from the drilling process to detect impending stall. The WOB parameter setpoint is then provided to the WOB controller 14, represented by the node 14 and WOB PID controller, that determines the WOB setpoint provided to the drilling process 16.

During the drilling process 16, the drilling control system 10 uses process outcomes to provide updated inputs to the parameter setpoints 21. Those controllers are also taking angular velocity and WOB data directly from the drilling process 16 to minimize the error between set point values and measured process values. As can be seen in FIG. 2, the process outcomes include high level or direct process outcomes and indirect process outcomes. Direct process outcomes include, but are not limited to measured WOB, angular velocity, fluid pressure, torque, vibrations and acceleration measured at the surface or from downhole sensors. Direct process outcomes may be referred to as top-hole outcomes. Indirect process outcomes, which are calculated or estimated from other direct measurements include but are not limited to rate of penetration (ROP), depth of cut estimation described below, and drilling dysfunction signaling. Indirect process outcomes can be determined from both surface and down-hole data. Referring again to FIG. 2, the method 10 further includes a downhole sensor data and processing function 30 that receives indirect and direct sensor data from down-hole sensors and provides a first output, signals that control downhole actuation systems that can provide a short-term bypass of higher-level control setpoints, and a second output, signals sent to the top-hole AOPC control system to enable setpoints to be changed accordingly. In an embodiment, the downhole and sensor processing 30 takes place downhole in a subsystem 72 and 74 that includes a microprocessor running algorithms that analyze direct and indirect process outcome measurements to detect the presence or onset of severe drilling dysfunction. In an embodiment, the top-hole sensor data may be available to the top-hole controllers at high bandwidth. In an embodiment, the down-hole sensor data may be available from low-bandwidth sensors and transmitted intermittently to the surface based on pre-determined events.

In an embodiment, downhole sensor data and processing 30 takes inputs from the downhole sensor data including torque, WOB, and RPM to estimate the instantaneous depth of cut (DOC). In an embodiment, the DOC estimation algorithm is executed on an embedded processor integrated into the downhole sensor suite. Regression and time-series forecasting models for predicting rate of penetration from noisy measurements of weight on bit, torque, depth, feed, and angular velocity are used for the DOC prediction. These include nonlinear regression models (regularized polynomial regression) and generative timeseries models. Methods are extended to include regularized linear regression, polynomial regression, and deep neural networks, as well as neural network architectures including Long Short-Term Memory (LSTM) networks. LSTMs are autoregressive models that keep track of the history as well as the current measurements during prediction. The multilayer perceptron neural networks and LSTM models are trained with a form of stochastic gradient descent called Adaptive Moment Estimation (Adam). Adam adapts the learning (or update) rate according to running estimates of gradient statistics (first and second moment). The models are trained on a training data set and validated on an independent holdout data set. FIG. 9 show the ability of the models to estimate ROP from the other measurements for several different datasets.

The ROP estimate is then used to identify if a torque overload or stick-slip condition is impending to inform the anti-stall controller 26. This is done by comparing the predicted DOC to a threshold value known to cause stick-slip. When the threshold is exceeded, an overload event is sent to the surface controller through the low-data rate communication (FIGS. 7, 74 to 78). Upon receiving the event signal, the event-based sensor fusion optimization controller 78 applies new operating set points for angular velocity, WOB, and fluid pressure.

In other embodiments, other drilling process parameters required for the drilling process such as, but not limited to down-hole fluid pressure may also be included in the control loop. These process parameters are also determined by the control system 12 from setpoints 21 and sensor fusion and optimization inputs 40 that are acted upon by a controller, such as but not limited to a PID controller to provide drilling process controls.

The following paragraphs describe process steps according to an embodiment of the disclosure. This embodiment includes applying a controlled drilling force, rotary speed, and fluid pressure from a top-hole system, using data available at high bandwidth from top-hole sensors and intermittent, low-bandwidth data from down-hole systems with event-driven fusion and optimization algorithms to autonomously determine setpoints for the controllable parameters, deploying downhole sensing and processing to obtain and interpret immediate information on the details of the rock-drillbit interactions, processing these measurements downhole and identifying dysfunction that risks equipment or wellbore integrity, deploying a downhole actuation module to take immediate action to protect the equipment and the wellbore in the presence of dysfunction, using low-bandwidth communications from the downhole system to the top-hole fusion and optimization system to communicate data and information about the rock-bit interactions and the status of the downhole actuation system.

In response to the force input (WOB) from step 14, and the angular velocity co from step 12, the interactions between the bit and rock then determine the outcomes of the drilling process at step 16. Drilling process outcomes at step 16 include the torque τ generated between the drill bit and the rock, the linear velocity v or ROP, and higher level metrics computed from the directly-measurable or estimable parameters such as the drilling efficiency or MSE. The high-level autonomous control system 10 generates desired setpoints for co and WOB based on the input and output drilling process parameters by implementing database- or model-based methods and local optimizations. Low-level tracking controllers (e.g. using proportional-integral [PI] or proportional-integral-derivative [PID] algorithms) may be used to achieve and regulate the input parameters specified by the high-level controller in accordance with the drilling rig system dynamics. Setpoints for ω and WOB, may be controlled, e.g., via hydraulic or pneumatic valves, depending on the drilling rig characteristics.

From step 16, control system 10 proceeds to step 18, the autonomous operating point control, or AOPC, process, to generate the preferred setpoints 21. AOPC 18 constitutes the optimization element of 78 and includes an estimator block 20. Block 20 received measured drilling process inputs 12, 14 and process outcome parameters from step 16, and estimates the Detournay parameters associated with the current rock type, as discussed in further detail below. These parameters are then compared with a database, or setpoint lookup 22. Based on setpoint lookup 22, predetermined appropriate setpoints are generated and transmitted to a supervisory controller 24 (labeled "change detection/local optimal search"). The Detournay parameters are also transmitted from step 20, to supervisory controller 24. Supervisory controller 24 performs two functions. First, supervisory controller 24 determines whether a change in outcome parameters 16 have occurred to indicate that a new material has been encountered. For example, a Bayesian change point detector may be used to determine a variation in rock formation.

If there is no significant change, then the setpoint values from the database are passed through to the low-level control system. If at step 24 a change in the material being drilled is indicated, then the supervisory controller 24 triggers and executes a local search for optimal operating conditions by accessing database 22, using the estimated Detournay parameters for the data segment. Generally, control system 10 searches for settings that minimize MSE, but it can also maximize ROP by co-optimizing the two, or optimize other metrics. One object may be to maximize over WOB a cost function f(WOB) defined as:

$$f(\mathrm{WOB})=A*\mathrm{ROP}(\mathrm{WOB})+B*1/\mathrm{MSE}(\mathrm{WOB}) \qquad \text{EQ. 4}$$

where A and B are selectable weights and ROP and MSE are both functions of WOB. Maximizing this expression would allow us to "co-optimize" the two metrics. Alternatively, a second function f1(WOB) could be constructed from the inverses of the terms in f(WOB); this function would be minimized as an alternate means of co-optimizing the ROP and MSE. In one embodiment an optimization algorithm such as a Golden Section Search may be employed about a fixed interval around the AOPC setpoint. In another embodiment, control method 10 may adaptively determine an initial search interval instead of a fixed interval.

Once parameter setpoints 21 have been generated at step 24, an anti-stall controller 26 receives setpoints 21 to determine whether stall conditions may exist at the adjusted setpoints 21. Stall conditions can occur when transitioning from a hard material—that requires a very high WOB—to a much softer material—that cannot tolerate high WOB. Softer rock layers generate significantly higher ratios of torque to WOB than harder rock layers. In response to the changing rock layers, torque τ may exceed system operational limits under high WOB and case the drill bit to stall. To avoid stall, anti-stall controller 26 monitors torque τ. If τ exceeds a configurable threshold value, e.g. 80% of the drill rig limits, anti-stall controller 26 reduces the target WOB at step 14, e.g., by an amount determined by a barrier function. The barrier function is configured to respond more rapidly to material changes than AOPC system 18. Barrier function may include a time constant of several seconds to filter noise encountered in the drilling process.

Figure 3:
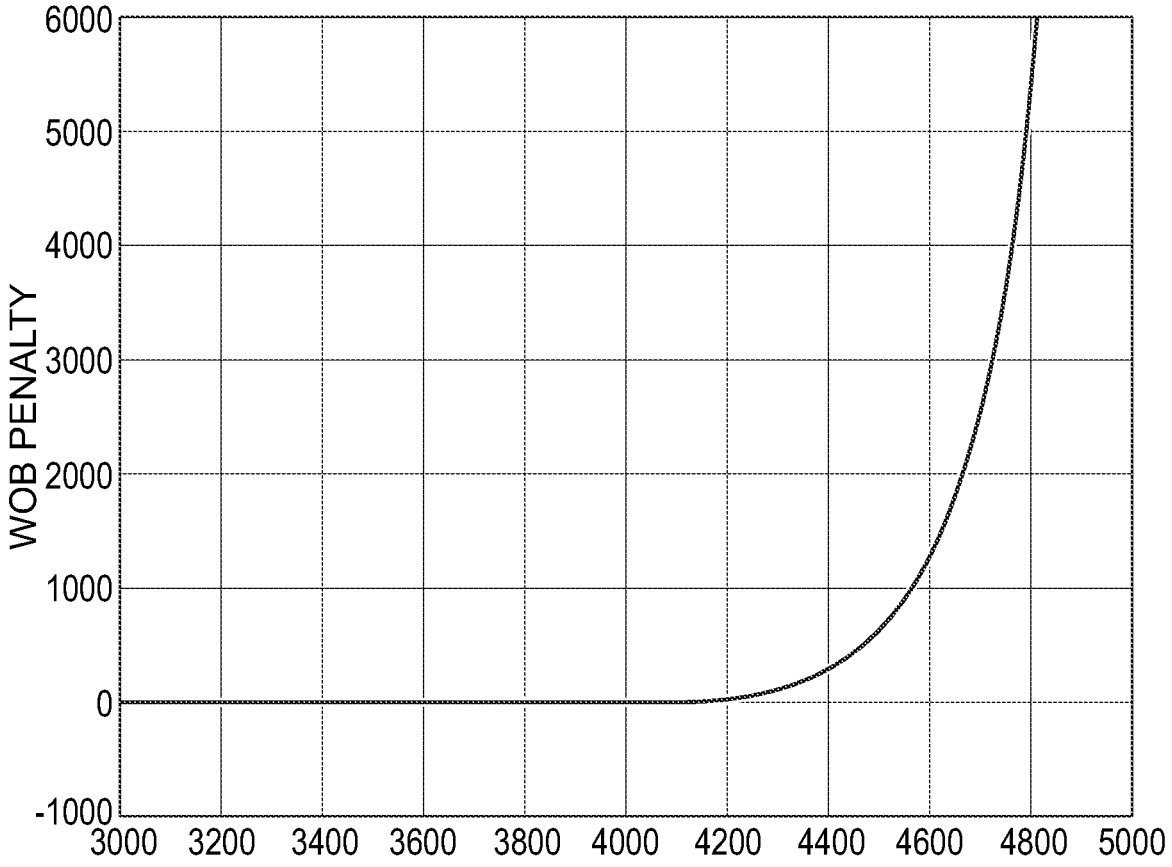
FIG. 3 shows an exemplary anti-stall barrier function of the disclosure.

Referring next to FIG. 3, an exemplary anti-stall barrier function is shown. A barrier functions may be used in numerical constrained optimization solvers to penalize approaching and exceeding the constraints. Ideally, a barrier function has no influence when the current state is far from the constraint but provides an increasing penalty approaching infinity as the constraint is approached. In one embodiment a barrier function may be implanted as the Equation 3 below:

$$y=\begin{cases} 0 & x<0 \\ k(\tan(x)-x) & 0<x<\pi/2 \\ \infty & x>\pi/2 \end{cases} \qquad \text{EQ. 3}$$

where $$x=\frac{\pi}{2}\frac{\tau-\tau_0}{\tau_c-\tau_0}.$$

The barrier function describe in Eq. 3 has an advantage by introducing no penalties until reaching the initial torque for a barrier penalty, to, and having a continuous first derivative below the critical torque, $\tau_c$. The parameter k can be used to adjust the rate at which the barrier function increases.

FIG. 3 shows an exemplary anti-stall barrier function according to an embodiment of the disclosure. In FIG. 3, k=3000, $\tau_0$=4000 and $\tau_c$=5000. The controller for system 10 may be configured to operate in the fast inner WOB control loop, allowing it to react much faster than the classifier, which can later be used to restrict desired WOB commands. Ultimately, the anti-stall performance relies on high bandwidth performance of the closed loop WOB system.

Material estimation in control system 10 may be determined by generating Detournay model parameters for each general type of rock layer that may be anticipated in the geological characteristics. When drilling rock layers, the rock type and drilling phases I, II, or III may then be classified as the Detournay model which is closest to measured data of Detournay parameters. For example, three types of rock layer material may be sandstone, concrete, and granite. Detournay parameters are specific to the drilling layer or medium, and to the configuration of the drill bit. Therefore, this approach requires either experimental profiles for a specific bit configuration, online machine learning to enable the automatic development of a database from real drilling data, or extensive modeling to capture the relevant bit characteristics.

Detournay models for each of the three exemplary rock types may be fit to test data using a least squares approach. An optimization fit seven parameters: $a_1$, $a_2$, and $a_3$ in the equations for both t and d, as well as $W_{12}$. The parameter $W_{23}$ may be selected, e.g., through a separate process as the w which provided the minimum MSE. Before computing the residuals, the data may be normalized based on a filtered maximum values for t and d over all tests.

Calculating the mathematical "distance" from the current operating point to the models may be implemented in two steps. Step one is to use the two bisecting planes of the three phases to determine which line segment is closest to the current set of Detournay parameters (estimated from measured data). Step one may be performed for each of model being tested. Once the closest segments are identified, standard computation of the distance from a point to a line is used to determine the distance to the model. Data may be normalized before distance is computed. These distances are compared, and the closest model is selected as the estimated rock for the current data point. An added benefit of this approach is that phase is also predicted by the model from the first step. Running this classifier on the training data results in about an 84% success rate in identifying sandstone, 86% success in identifying concrete, and 99% success in identifying granite. Any confusion may result from the fact that the models for sandstone and concrete are fairly close to each other in some portions of the torque, frequency and distance range. When integrated with the autonomous controller, a mode filter may be implemented on the classifier output to prevent control behavior transitions from occurring in response to noise in the classifier output. A mode filter may take the mode of the rock estimate over a predetermined interval, e.g., between 1 second to 10 seconds, and more preferably from 3 seconds to 5 seconds, although other time intervals may be applied depending on rock layer characteristics.

In one embodiment a controller for system 10 may be a PC-based supervisory control and data acquisition (SCADA) system integrated with data acquisition hardware. Process data may include WOB, torque, rotary speed, and drill head position. WOB may be calculated, e.g., from measured differential pressure across the hydraulic cylinders. Torque may be determined by measuring the input pressure to a hydraulic drive motor (not shown). Rotary speed may be determined using a rotary pulse generator on the hydraulic motor. A linear potentiometer may be used to determine a drill-string position.

In one exemplary embodiment a controller of control system 10 comprises a LabView virtual instrument (VI) integrated with MATLAB for data processing. Real-time estimation and control calculations are performed in the Labview VI, in some cases using embedded MATLAB scripts. The VI interfaces with the data acquisition hardware and displays the process variables to the operator via the display. Data may be acquired at a sampling rate of 2048 samples per second and collected in 256 sample increments. The collected data is then processed in MATLAB for analysis. Rotational speed of the drill head is controlled using voltage-controlled proportional valves which modulate the hydraulic fluid flow to the rotation motor. A pressure relief valve may be used to limit output torque. WOB may be controlled using voltage-controlled proportional valves which modulate the hydraulic cylinder pressures.

Proportional-integral (PI) or PID feedback controllers may be used to achieve low-level control to regulate rotary speed and applied WOB. Control signals transmitted from the controller direct the behavior of the hydraulic valves.

Figure 4:
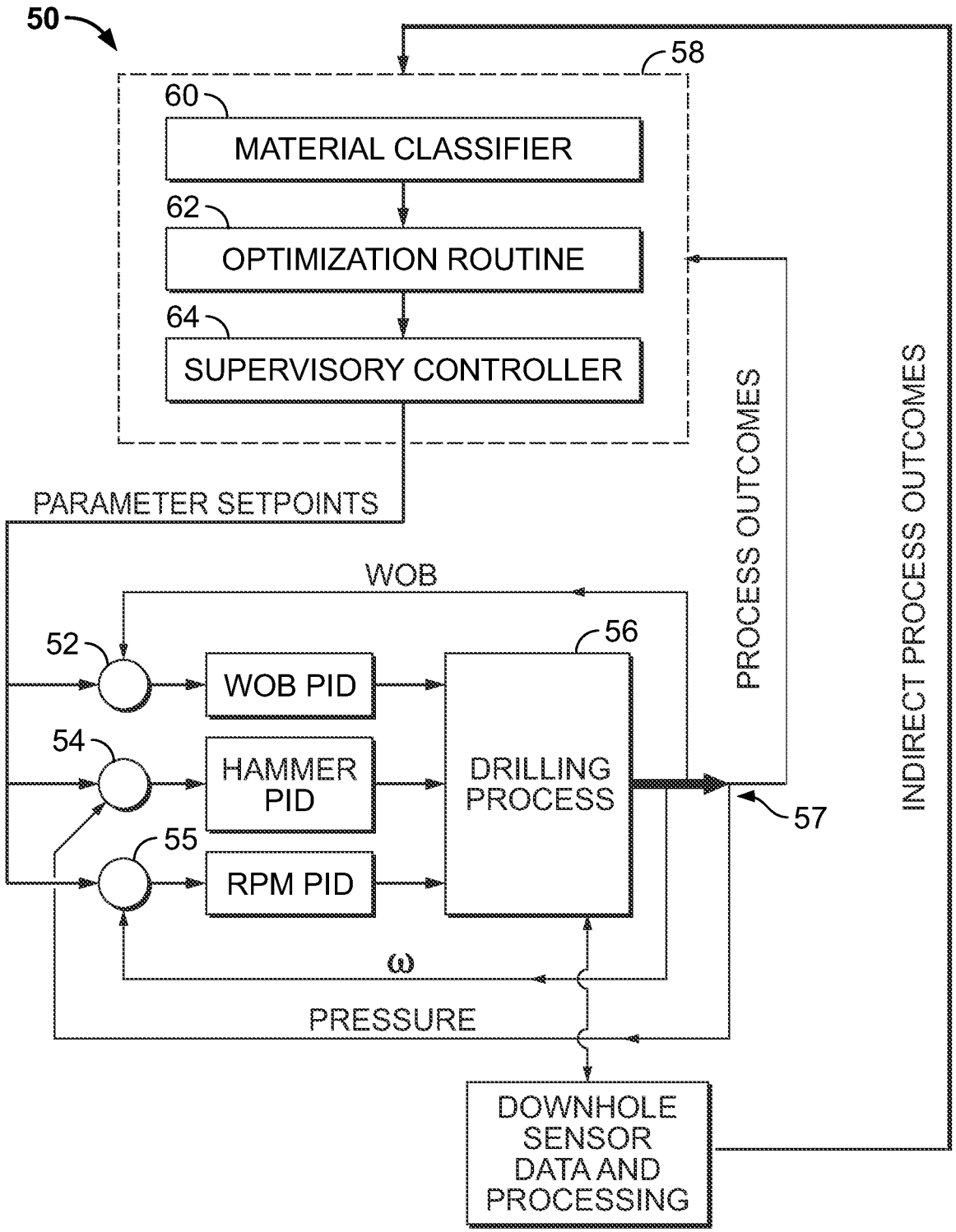
FIG. 4 shows an alternate embodiment for an autonomous drilling control method for classifier driven control of a percussive drilling system.

FIG. 4 shows an embodiment for an autonomous drilling control system 50 for percussive drilling through multi-layer materials. At a low level, a series of controllers as described with respect to autonomous rotary drilling methods, above, regulate the individual control parameters to their desired values in real-time. Separate controllers may be used to regulate the weight-on-bit, hammer pressure, and the rotary speed. The setpoints for these parameters may be dictated by a higher-level controller, analogous to autonomous operating point controller 18, or AOPC, as described above with respect to FIG. 2 for rotary drilling. Specifically, at step 52, the drilling control system 50 controls the force applied to the rock by the bit, termed the weight-on-bit (WOB). At step 54, drilling control system 50 sets a hammer pressure, and at step 55 drilling control system 50 sets a rotary speed. WOB 52, hammer pressure 54 and rotary RPM are transmitted to a drilling rig for carrying out a drilling process 56. As the drilling rig penetrates into rock layers, process parameter outputs 57 are transmitted to a controller in response to the input parameter setpoints 52, 54, 56. The interactions between the bit and rock then determine the outcomes of the drilling process at step 57. Drilling process outcomes at step 57 include the torque $\tau$ generated between the drill bit and the rock, the linear velocity v or ROP, and higher level metrics such as the drilling efficiency or MSE. A system controller 58 is configured to receive signals 57 from drilling process 56.

As in FIG. 2, at steps 52, 54, 55, drilling control system 50 uses the parameter setpoints, measured torque from the drilling process and sensor fusion and optimization inputs 40 derived from top-hole and/or bottom-hole sensors 30 to set WOB, hammer pressure, and angular velocity co (RPM), respectively, for the drilling process 56. In an embodiment, the sensor data may include weight on bit (WOB), rotary speed, and fluid pressure from top-hole sensors. In an embodiment, the top-hole sensor data may be available at high bandwidth. In an embodiment, the sensor data may include torque, rotary speed, acceleration, and WOB from down-hole sensors. In an embodiment, the down-hole sensor data may be available from intermittent, low-bandwidth sensors. As can be seen in FIG. 4, the process 50 includes both the use of indirect process outcomes and downhole sensor data and processing as discussed above in the rotary drilling process controls.

The AOPC sensor fusion and optimization is discussed next. In an embodiment, an optimization algorithm such as the golden section search (GSS) described in [0070] can be executed in the downhole processor. Based on the GSS results, an event signal is sent top hole controller to prescribe a new operating set point for WOB. This process would repeat until a setpoint that maximizes a desired output variable such as rate of penetration is reached. When a material transition is detected, the process would repeat again.

According to another embodiment of the disclosure, a control method is disclosed that includes applying a controlled drilling force, rotary speed, and fluid pressure from a top-hole system, using data available at high bandwidth from top-hole sensors and intermittent, low-bandwidth data from down-hole systems with event-driven sensor fusion and optimization algorithms to autonomously determine setpoints for the controllable parameters, deploying downhole sensing and processing to obtain and interpret immediate information on the details of the rock-drill bit interactions, processing these measurements downhole and identifying dysfunction that risks equipment or wellbore integrity, deploying a downhole actuation module to take immediate action to protect the equipment and the wellbore in the presence of dysfunction, using low-bandwidth communications from the downhole system to the top-hole sensor fusion and optimization system to communicate data and information about the rock-bit interactions and the status of the downhole actuation system.

Referring again to FIG. 4, the high-level system controller 58 first determines the drilling medium (for example soft rock, hard rock, or metal) by applying a material classifier block 60 to measured drilling data 57. Changes in the drilling medium trigger changes in control, dictated by an optimization block 62. The optimization block 62 is controlled by a supervisory controller 64 that triggers optimization sequences when drilling medium changes and implements administrative functions in system controller 58.

When the material classifier determines that a medium change is indicated, e.g., from rock to another rock type, or to a metal, the system executes an optimization algorithm, e.g., the golden section search as described above, to determine setpoint parameters 52, 54, 56, to generate optimal operating conditions associated with the respective material of the rock layer being drilled. E.g., when the medium changes to metal, control system 50 executes a predetermined drilling process in which maximum WOB is applied. WOB may optionally be periodically reduced by the system 50, e.g., to allow cuttings to clear the borehole.

In one exemplary embodiment of percussive autonomous drilling control system 50, only WOB is varied in real-time. When using separate power sources for hammer pressure and rotation, performance is effectively maximized when both of these parameters are maximized. WOB therefore provides the variable parameter that determines drilling success, failure, and performance.

In another exemplary embodiment, the hammer and rotary motor share a single power supply. Therefore, to obtain optimal performance, the hammer pressure setpoint 54 and rotary speed are autonomously traded against each other in real-time to maximize performance. In this case, control system 50 varies all three control parameters (WOB, hammer pressure, and rotary speed) autonomously in real-time.

In one embodiment the optimization algorithm implemented in optimization block 62 may be referred to as a golden section search (GSS) algorithm. The GSS algorithm assumes that the global extrema lies within a search interval (a,b), and that the objective function is unimodal between (a,b) [28]. The search space is sequentially searched with decreasing intervals based on the golden ratio. This approach is well suited for ROP optimization because the limits (a,b) may be determined analytically using Hustrulid's model of the physics of percussive drilling, which defines the bounds of the drilling Phases based on parameters of the drilling medium and the drilling process. The GSS algorithm may then be performed within this smaller interval.

The GSS may be implemented in the Labview control software or any other control software. Sampling intervals in the range of 10 to 20 seconds may be used to ensure that parameters stabilize and provide a large signal-to-noise ratio for an average ROP estimate. The average ROP may be calculated by dividing the change in depth from the beginning to the end of the calculation interval by the time interval. This substantially smooths the rate calculation. In addition, a shorter interval, or measurement interval, is used after a fixed delay. The fixed delay may be introduced to enable the WOB to converge to the setpoint, and eliminate effects of elasticity in the drill rig or test fixture components. Elasticity in the drill rig or test fixture can show up as drill depth changes when WOB is modulated. Once the search is completed, the best setting is chosen from all the settings that were sampled.

Figure 5:
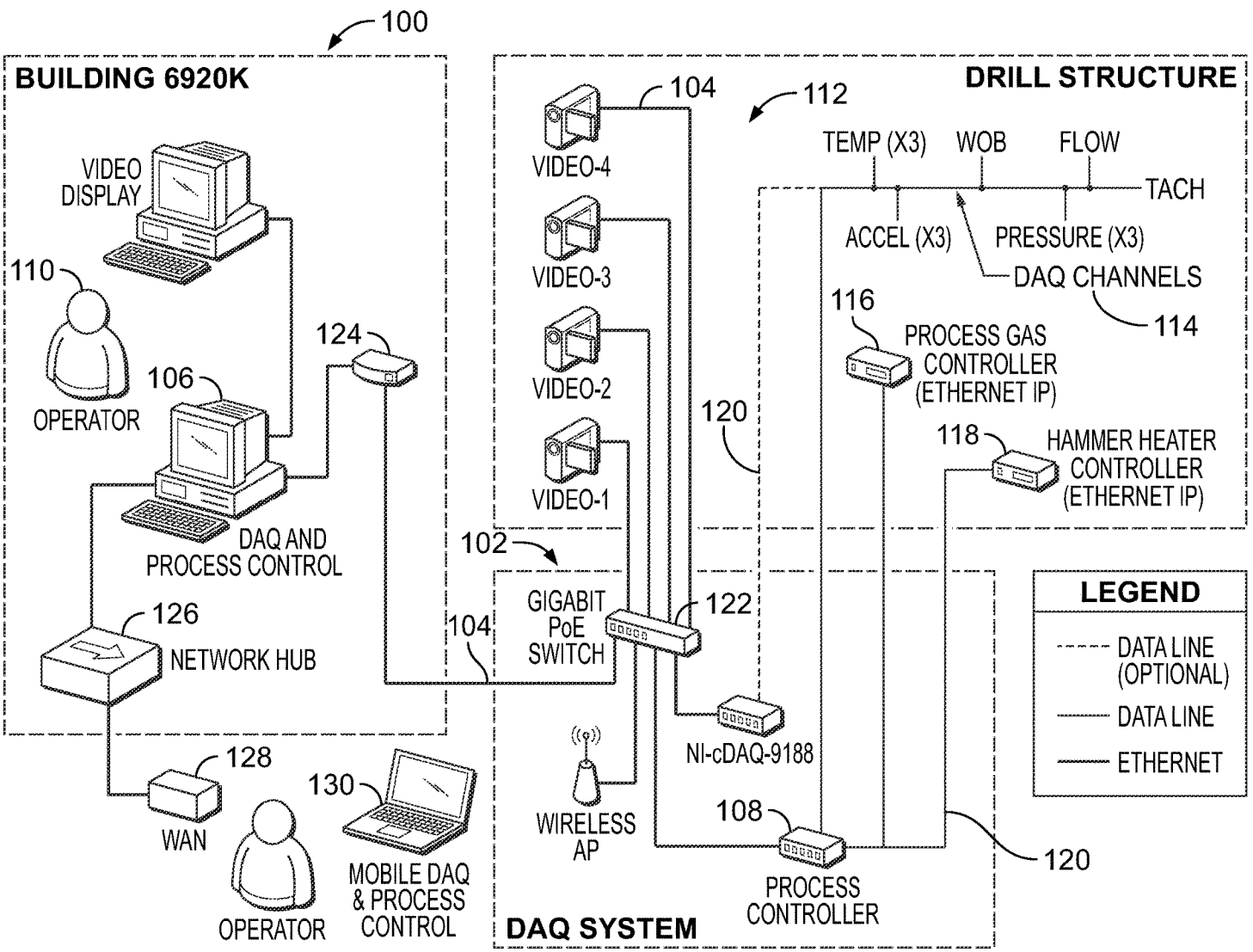
FIG. 5 shows an exemplary hardware architecture for an autonomous drilling system of the disclosure.

Referring next to FIG. 5, in an embodiment autonomous drilling control system 10 or 50 may include local area network (LAN) or wide area network (WAN) generally designated as 100 and data acquisition (DAQ) hardware 102 configured with control software as described above. An Ethernet connection 104 or other communication link is provided between the actual drill facility and the control center. The DAQ 102 may be, e.g., a Model cDAQ-9188 by National Instruments. Data acquisition system 102 may be operated in conjunction with a PC as in a SCADA system or as a standalone controller with access to DAQ 102 for both data and control to allow for remote operation. A human machine interface (HMI) control interface 106 may be implemented via National Instruments LabView. The controller 106 provides an operator 110 with real-time feedback on all the measured operating parameters from the drilling operation. Operator 110 controls WOB, hammer pressure, and motor speed. Each of these parameters has closed-loop PID control (see, e.g., FIG. 2, FIG. 4) to maintain the operating setpoints as drilling conditions change. An optional AutoDrill module may be used that controls the operating parameters without user intervention. Data acquisition system 102 receives data from the drilling system 112 via a data links 120 in data communication with the drilling system 112. Data acquisition system channel 114 transmits drilling parameters from the drilling system 112, e.g., temperature of the drill bit, weight on bit, flow, pressure, tachometer, pressure and acceleration/accelerometer data. A process gas controller 116 and a hammer heater control 118 may be connected to a process controller 108 via Ethernet IP over data links 120. These settings are used to control environmental conditions to be representative of real-world drilling environments. Process controller 108 transmits data through a switch 122 and router 124 to data acquisition system and central process controller 106. A network hub 126 may optionally be connected through a wide area network 128 to mobile terminals 130 for data acquisition and process control.

In addition to control schemes described above, alternate control methods may be applied with the scope of the invention and the appended claims. E.g., single parameter regulation may be used, wherein a single parameter, e.g. the drilling torque, is regulated to a predetermined fixed value regardless of the drilling medium, and the remaining control parameters, e.g. WOB modulated either to preserve the torque value, or according to a rules based model. Another optional control method may be a material estimator in which parameters characterizing the drilling medium are estimated from real-time measurements, and optimal settings for that material may be selected from a lookup table or via algorithms. Another alternate control method that may be used in the control system 10, 50, is a nonlinear adaptive control wherein a model of rock-bit interaction can be parameterized, e.g. using the Detournay construct. This mode may be applied, for example, in a plant model and adaptive control methods used to adapt to drilling parameters as they change. Another optional method for the control system 10, 50 may be reinforcement learning. Adaptive, learning or optimal controllers may either be applied to subsystems or to the entire system. In the approaches described above, low-level control may be handled separately in order to partially isolate the dynamics of the drilling rig from the drilling process. Thus, adaptive or learning methods may be applied solely to the higher-level control. Alternately, the control system may apply any of the aforementioned control methods directly to the low-level control inputs, enabling direct adaptation to the full system dynamics.

Figure 6:
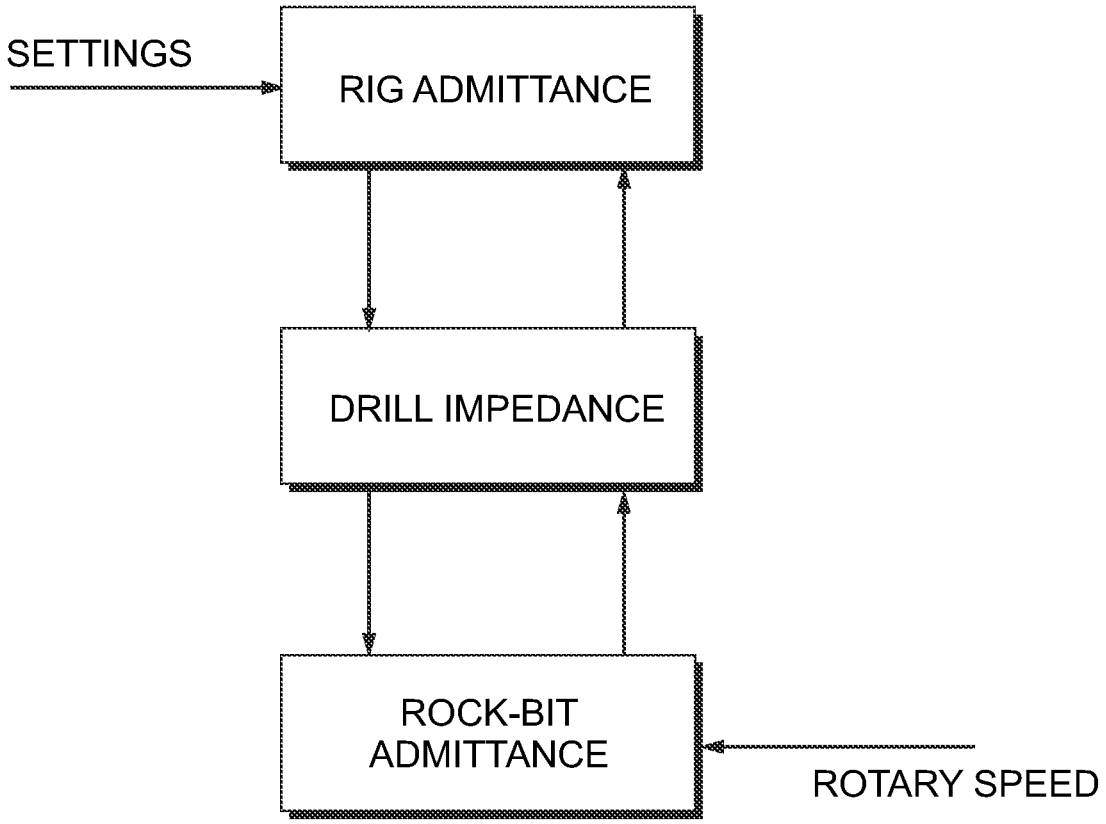
FIG. 6 shows an alternative embodiment for modeling and controlling a drilling system using port functions.

FIG. 6 shows an alternative construct for modeling and controlling a drilling system using port functions is shown. This approach may be used for either rotary or percussive drilling. Port functions, such as impedance or admittance, mathematically define the behavior of dynamical systems based on the way they relate conjugate power variables at one or more particular ports of interaction with other physical systems, e.g. their environment. For example, a mechanical impedance function describes the force output provided by a dynamical system in response to an imposed velocity at a specific physical location on the system. Force times velocity equals power, hence, force and velocity are conjugate power variables. Mechanical admittance is the inverse of impedance. Prior work has shown that using control systems to regulate the port behavior (e.g. impedance or admittance) of a system is an effective way to manage physical interactions in which significant forces and energy are exchanged between subsystems. The power of this approach lies in regulating only properties of the system under control, rather than properties such as force or motion which depend on a mating environment or physical system to be achieved (e.g. an environment to react an applied force). The method of FIG. 6 provides impedance control of the drilling system, in which the dynamic behavior as applied to the drilling medium, or rock, are regulated. Rather than regulate properties which depend on both the properties of the drill system and the variable properties of the rock, e.g. WOB, torque, speed, etc., port function control regulates properties of the drill rig alone, such as its apparent stiffness. E.g., an impedance controller may regulate the dynamic, frequency-dependent ratio of WOB to rate of penetration in the linear axis as well as the ratio of torque to angular velocity in the rotary axis. Setpoints for the controllable motion and force input parameters of the drilling rig (weight on bit, rotary speed) are generated dynamically and autonomously based on measured output parameters of the drilling process such as force and rate of penetration. In one embodiment, the rate of penetration is measured or estimated and is used as the input to a particular impedance function, which produces as an output an instantaneous force required to create a certain dynamic behavior. This instantaneous force becomes the new weight-on-bit setpoint. Similarly, the torque is measured or estimated and is used as the input to a particular admittance function, which produces as its output an instantaneous rotary speed required to create a certain dynamic behavior. This becomes the new rotary speed setpoint. Thus, instead of implementing particular weight-on-bit and rotary speed setpoints for drilling a particular drilling medium, the control system implements particular linear and rotary dynamic behaviors (e.g. inertia, stiffness, and dissipative behavior) that have been identified from simulations and prior drilling data to achieve optimal drilling in the particular medium.

In addition to providing a means of drilling process control, FIG. 6 provides a method for material classification and identification, e.g., the drilling medium may be defined in terms of the relationships between port variables, such as the rock's effective stiffness (ratio of WOB to depth of cut). Since the dynamic port behavior of the drilling rig is specifically regulated, it is known. Thus, by observing the actual output parameters of the drilling process, the dynamic port behavior (especially the stiffness and friction characteristics) of the drilling medium may be inferred, and from this the material may be determined. The approach described above in which drilling medium is classified via the three dimensional space of Detournay variables corresponding to WOB, torque, and depth of cut, is one embodiment of this type of material classification.

Figure 7:
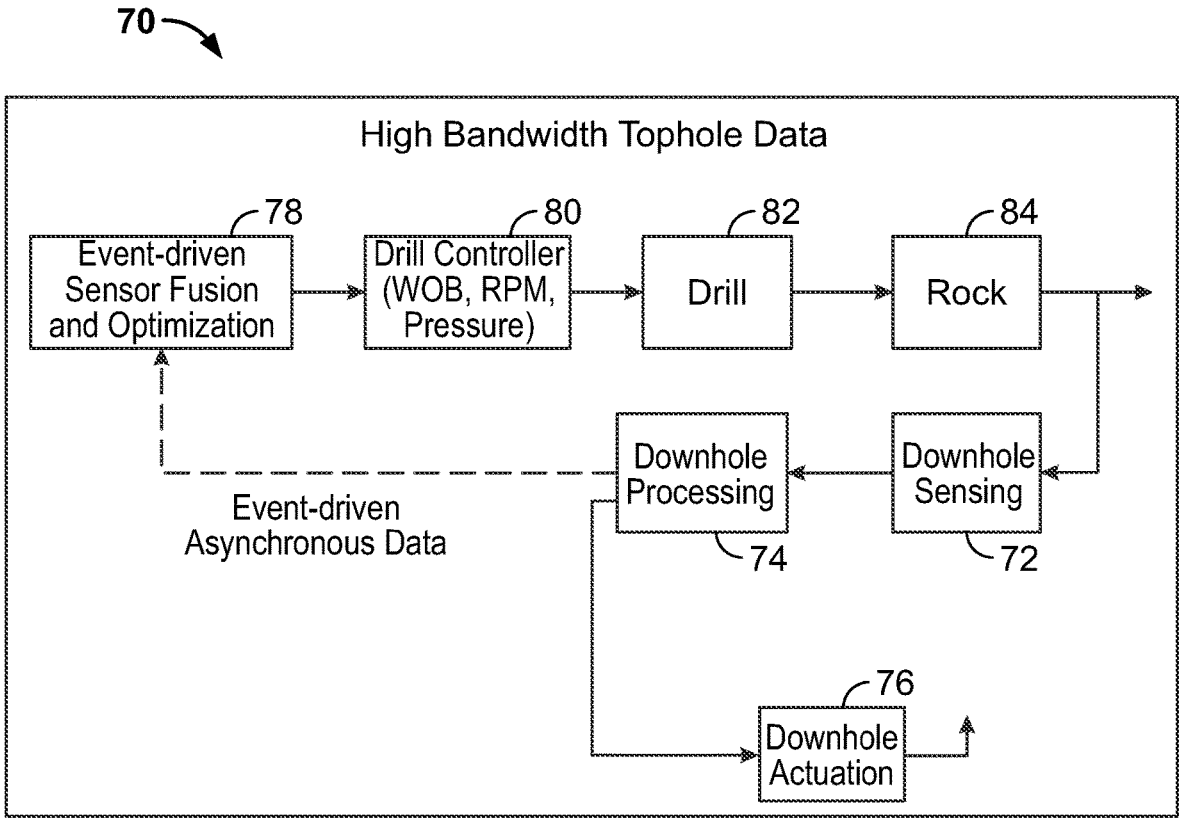
FIG. 7 shows a drilling system control architecture according to an embodiment of the disclosure.

FIG. 7 shows a drilling system control process 70 according to an embodiment of the disclosure. The drilling system control sub-architecture presents a novel way of using the control scheme described in the previous paragraphs for estimating downhole process conditions such as depth-of-cut and consequently ROP, and minimizing drilling dysfunctions such as stick-slip. As can be seen in FIG. 7, the control process 70 consists of three primary components combined in a unique and innovative fashion to minimize drilling dysfunction: 1) intelligent downhole process estimation (e.g. depth of cut estimation) from downhole sensing 72 and downhole processing 74, which generalizes to the measurement or estimation of any parameter or set of parameters relevant to the drilling process or drilling dysfunction, 2) rapid downhole actuation 76, 3) and event-driven estimation/optimization from both downhole and top-hole sensors 78.

The downhole sensing and data processing sub include sensors, signal processing, and intelligent algorithms that are capable of detecting important characteristics of the drilling process that are indicative of drilling dysfunction. These may include direct measurements of issues with the drilling system (stick/slip motion, excessive torque, etc.), detection of significant changes in drilling conditions (particularly those that are rapid or sudden), identification of drilling process or drilling medium (e.g. rock) parameters, or other quantities that provide insight into the drilling process. Examples of measured physical quantities could include drilling torque, force, depth of cut, rotary speed, vibrations, temperature, pressure, and sound. As such, this sub executes intelligent algorithms that rapidly characterize the drilling process or detect pathologies in it. In the current embodiment, the material detection algorithm along with the depth of cut estimation are deployed in the downhole sensing sub. A wide variety of algorithms could be used in the sensing and processing sub, including change detection algorithms, pre-trained neural networks to identify material or process changes, etc.

In one embodiment, the downhole sensing sub consists of an onboard microcontroller, torque sensor, force sensor, and an inertial measurement unit (IMU). Data from the sensors (torque, force, IMU) are analyzed in the microcontroller which executes the ROP estimation algorithm FIG. 9. The algorithm estimates the drilling depth of cut (DOC) in real-time to estimate both the formation material as well as the potential for impending drilling dysfunction. The DOC and other parameters are used to index a condensed database of past known drilling conditions, or used in mathematical functions that describe drilling, to determine whether or not the drilling parameters represent a safe drilling condition. Other sensor types, including but not limited to acoustic sensors (characterizing the drilling process by sound), optical sensors, pressure or flow sensors (e.g. measuring properties of drilling fluid upstream and/or downstream of cutting process), etc. could also be included. If certain conditions indicating drilling pathologies are indicated by processing the measurements via databases or functions describing drilling conditions, for example drilling conditions or outcomes (e.g. vibrations) indicating large stick/slip oscillations, conditions approaching stuck or stalled bit, or other dysfunctions, this triggers output from the downhole sensing and processing sub to the downhole actuation system.

The sensing sub is coupled with rapid response downhole actuation and with surface processing to implement the dysfunction mitigation control scheme. The downhole actuation portion utilizes near-bit rapid actuation to prevent acute damage. This can be implemented with an actuated clutch or similar mechanism as shown in FIG. 8. The clutch would allow applied torque to reach the drill bit under normal drilling conditions. However, if the system detects impending or active dysfunction (e.g. imminent stick-slip, excessive vibrations or resonance, excessive weight-on-bit or torque, etc.), it would release the rapid control action clutch and would minimize or eliminate the torque transmitted through the drill string, preventing or releasing twist.

To mitigate the deleterious impact of dysfunction such as stick slip, the toggle lock is actuated via signals sent from the embedded process sensing module when drilling dysfunction is detected. A combination of rotational speed, predicted depth of cut, are combined in the sensing module to trigger toggle lock to prevent the stored energy in the drillstring due to torsional windup.

While the current embodiment focuses on relieving torque transmission, a similar approach could be used to temporarily relieve the transmission of weight on bit (or linear force) from the surface to the bit. Alternative embodiments could affect different mechanical changes directly on the drilling system or process, for example by retracting cutting elements from a bit, introducing lubricant to temporarily reduce torque, or other methods known to those skilled in the art. Because simply releasing the torque is not a long-term solution, the downhole system also alerts the system controller at the surface of the dysfunction, in order to change the operating conditions that caused the pathology in the short term (e.g. by stopping the drill entirely), and/or to establish new operating set points that avoid those conditions when it is safe to resume drilling. Ultimately, it is desirable to restore the transmission of torque (or force) through the actuation mechanism. This might happen via an electronic (or mud pulse) signal from the surface or from the sensing system. Or this might happen via a sequence of mechanical operations (rotations and force vectoring) from the surface. In the current embodiment, one of two things will cause the actuator system to re-engage its clutching mechanism: 1) If it receives a signal from the sensing module, it will re-engage, or 2) If it reaches a thermal limit or internal timeout, it will re-engage to avoid internal damage.

Several key considerations drive the design of actuation module embodiments. First, the module must be fast acting (at sub-second timescales, preferably sub-100 msec) in order to relieve loads before components are damaged. Second, in many cases, the sub must include a large, clear channel to allow the flow of drilling fluid. Third, the sub must generally be self-contained and self-powered, since it cannot depend on other drilling system elements for infrastructure support. Fourth, the sub must support very large loads in both torsion and linear force. These depend on the scale of the drilling system, but even for small diameter holes (~4-5"), torsional loads are in the hundreds of foot-lbs and weight on bit (linear compressive force) may be thousands of pounds. Because the actuation system generally needs to fit in a small space (e.g. a small annular cross section around a central fluid channel), it is not generally possible for the actuator to directly support these loads. Thus, indirect actuation via secondary actions is a preferred approach.

In this concept, a "toggle lock" mechanism is used to drive cylindrical pins, sideways, into mating features to engage the clutch between the drill string and the drill bit. When engaged, the clutch transmits torque. When disengaged, torque is not supported, and the drill string can free spin independent of the drill bit. The toggle mechanism does not bear drilling loads, it simply restrains the pins in place where they carry the load directly. This mechanism can be driven with a modestly powered electromagnetic coil and is straightforward to assemble. The custom electromagnetic coil functions as a linear solenoid, pulling its core when actuated.

An exemplary embodiment of the control electronics for the toggle lock includes a simple H-bridge driver circuit with a microcontroller to enable more advanced control, such as bounce/jitter rejection, prescribed actuation timeouts, etc. The control board includes an H-bridge as the primary drive element and a high current carrying plane.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

The present application contemplates methods, systems and program products on any machine-readable media for accomplishing its operations. The embodiments of the present application may be implemented using an existing computer processors, or by a special purpose computer processor for an appropriate system, incorporated for this or another purpose or by a hardwired system.

It is important to note that the construction and arrangement of the autonomous drilling systems as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means plus function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

As noted above, embodiments within the scope of the present application include program products comprising machine-readable media for carrying or having machine-executable instructions or data structures stored thereon. Such machine-readable media can be any available media which can be accessed by a general purpose or special purpose computer or other machine with a processor. By way of example, such machine-readable media can comprise RAM, ROM, EPROM, EEPROM, CDROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media.

Machine-executable instructions comprise, for example, instructions and data which cause a general purpose computer, special purpose computer, or special purpose processing machines to perform a certain function or group of functions.

It should be noted that although the figures herein may show a specific order of method steps, it is understood that the order of these steps may differ from what is depicted. Also, two or more steps may be performed concurrently or with partial concurrence. Such variation will depend on the software and hardware systems chosen and on designer choice. It is understood that all such variations are within the scope of the application. Likewise, software implementations could be accomplished with standard programming techniques with rule based logic and other logic to accomplish the various connection steps, processing steps, comparison steps and decision steps.

We claim:

1. A method for autonomously controlling a drilling system comprising:

applying a predetermined force setpoint to a first controller; applying a predetermined rotary speed to a second controller;

applying a first controller output and a second controller output to a drilling process module; measuring a plurality of outcome parameters of the drilling process module;

receiving drilling process inputs from downhole sensor data and processing and process outcome parameters;

estimating a plurality of rock parameters associated with a rock type;

comparing the estimated rock parameters with a database of rock profiles; determining whether a change in the outcome parameters have occurred which indicate that a change in the drilled material has occurred;

searching the database rock profiles for optimal operating conditions in response to determining that a change in the material being drilled is indicated;

generating an updated set of drilling parameters corresponding to the optimal operating conditions rock parameters in response to the comparing of database rock profiles by executing machine-executable instructions stored in a computer;

transmitting the updated set of drilling parameters comprising the force setpoint and rotary speed setpoint;

adjusting the drilling parameters by subtracting measured drilling parameters from the updated set of drilling parameters; and generating adjusted drilling parameter setpoints for predetermined force and predetermined angular velocity; and determining whether the adjusted drilling parameter setpoints are approaching stall conditions;

wherein the step of determining stall conditions further comprises:

monitoring the torque;

determining that the torque exceeds a predetermined torque;

reducing the target weight on bit by an amount determined by a barrier function configured to respond more rapidly to material changes.

2. The method of claim 1, wherein the method further comprises sensing one or more top-hole parameters.

3. The method of claim 2, wherein sensor fusion and optimization processing is used with data from the one or more top-hole and/or down-hole sensors to detect material transitions.

4. The method of claim 3, wherein impending drilling dysfunctions associated with the material transitions are determined and drilling process parameter set points are regulated to optimize the process by maximizing measured rate of penetration, and/or minimizing calculated mechanical specific energy, and/or minimizing the duration and amplitude of drilling dysfunctions.

5. The method of claim 4, wherein the regulated drilling process parameter set points are selected from the group including rotary speed, WOB, and fluid pressure.

6. The method of claim 1, further comprising transmitting a plurality of phase parameters to a controller; the plurality of phase parameters comprising a first phase, a second phase and a third phase; the first phase comprising a contact area of a cutter tool to increase in response to a depth of a cut slowly increases with the angular velocity; the second phase comprising a depth of cut wherein an increase in a force weight of the cutter increases a cutting force associated with a predetermined efficient parameter for a desired point; and the third phase comprising a region following an end point of the second phase in which the predetermined efficiency parameter decreases as angular velocity increases.

7. The method of claim 1, further comprising maintaining the setpoint values in response to determining that no significant change occurred in the drilling material.

8. The method of claim 1, further comprising searching the database for drilling parameters associated with maximizing drilling efficiency.

9. The method of claim 1, further comprising searching the database for identifying drilling parameters associated with maximizing linear velocity of the drilling tool.

10. The method of claim 1, further comprising searching the database for drilling parameters associated with co-optimizing linear velocity and drilling efficiency.

11. The method of claim 1, further comprising performing a search for optimal drilling conditions about a fixed interval around an autonomous operating point control setpoint.

12. The method of claim 1, further comprising adaptively determining an initial search interval around a predetermined setpoint.

13. The method of claim 1, further comprising: filtering noise associated with the drilling process by including a time constant of several seconds for a barrier function to take effect.

14. The method of claim 1, wherein the drilling process outcomes comprise a torque generated between the drill bit and the rock, a linear velocity v and a drilling efficiency parameter.

15. The method of claim 1, further comprising regulating the input parameters using proportional-integral-derivative controllers.

16. The method of claim 1, further comprising:

controlling autonomous drilling via port function comprising an impedance or admittance, to mathematically define the behavior of dynamical systems based on the way to relate conjugate power variables at one or more particular ports of interaction.

17. A method for autonomously controlling a drilling system comprising:

applying a predetermined force setpoint to a first controller; applying a predetermined rotary speed to a second controller;

applying a first controller output and a second controller output to a drilling process module; measuring a plurality of outcome parameters of the drilling process module;

receiving drilling process inputs from downhole sensor data and processing and process outcome parameters;

estimating a plurality of rock parameters associated with a rock type;

comparing the estimated rock parameters with a database of rock profiles; determining whether a change in the outcome parameters have occurred which indicate that a change in the drilled material has occurred;

searching the database rock profiles for optimal operating conditions in response to determining that a change in the material being drilled is indicated;

generating an updated set of drilling parameters corresponding to the optimal operating conditions rock parameters in response to the comparing of database rock profiles by executing machine-executable instructions stored in a computer;

transmitting the updated set of drilling parameters comprising the force setpoint and rotary speed setpoint;

adjusting the drilling parameters by subtracting measured drilling parameters from the updated set of drilling parameters; and generating adjusted drilling parameter setpoints for predetermined force and predetermined angular velocity; and controlling autonomous drilling via port function comprising an impedance or admittance, to mathematically define the behavior of dynamical systems based on the way to relate conjugate power variables at one or more particular ports of interaction.

* * * * *